US011063367B2

(12) United States Patent
Chen et al.

(10) Patent No.: US 11,063,367 B2
(45) Date of Patent: Jul. 13, 2021

(54) DUAL BAND SLOT ANTENNA

(71) Applicant: HEWLETT-PACKARD DEVELOPMENT COMPANY, L.P., Houston, TX (US)

(72) Inventors: Ju-Hung Chen, Taipei (TW); Shih Huang Wu, Houston, TX (US); Hao Ming Chen, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 32 days.

(21) Appl. No.: 15/748,311

(22) PCT Filed: Nov. 10, 2015

(86) PCT No.: PCT/US2015/059808

§ 371 (c)(1),
(2) Date: Jan. 29, 2018

(87) PCT Pub. No.: WO2017/082863

PCT Pub. Date: May 18, 2017

(65) Prior Publication Data

US 2018/0219297 A1 Aug. 2, 2018

(51) Int. Cl.
*H01Q 13/10* (2006.01)
*H01Q 5/364* (2015.01)
(Continued)

(52) U.S. Cl.
CPC ..... *H01Q 13/10* (2013.01); *H01Q 5/342* (2015.01); *H01Q 5/364* (2015.01); *H01Q 7/00* (2013.01); *H01Q 9/0421* (2013.01)

(58) Field of Classification Search
CPC ..... H01Q 13/10; H01Q 9/0421; H01Q 5/342; H01Q 7/00; H01Q 5/364; H01Q 21/0062; H01Q 9/0407; H01Q 13/18; H01Q 21/0062; H01Q 13/103; H01Q 13/106; H01Q 13/16
See application file for complete search history.

(56) References Cited

U.S. PATENT DOCUMENTS 5,627,550 A * 5/1997 Sanad ..... H01Q 1/2275 343/700 MS
6,140,966 A * 10/2000 Pankinaho ..... H01Q 1/243 343/700 MS
(Continued)

FOREIGN PATENT DOCUMENTS

CN 200959369 10/2007
CN 102263571 A 11/2011
(Continued)

OTHER PUBLICATIONS

Fujio, S. et al, "Dual Band Coupled Floating Element PCB Antenna" Jun. 20-25, 2004.

*Primary Examiner* — Dimary S Lopez Cruz
*Assistant Examiner* — Bamidele A Jegede
(74) *Attorney, Agent, or Firm* — HPI Patent Department

(57) ABSTRACT

Dual band slot antenna is described. The dual band slot antenna includes a ground plane having a slot, a conductive patch, a dielectric substrate disposed between the conductive patch and the ground plane, and a coaxial cable fastened on the conductive patch to form a first loop region and a second loop region of different sizes for dual band operation.

15 Claims, 9 Drawing Sheets

(51) Int. Cl.

| | |
|---|---|
| ***H01Q 9/04*** | (2006.01) |
| ***H01Q 7/00*** | (2006.01) |
| ***H01Q 5/342*** | (2015.01) |

(56) References Cited

U.S. PATENT DOCUMENTS

| | | | | |
|---|---|---|---|---|
| 6,545,640 | B1 * | 4/2003 | Herve | H01Q 1/243 343/700 MS |
| 6,809,689 | B1 * | 10/2004 | Chen | H01Q 9/0421 343/700 MS |
| 7,148,846 | B2 | 12/2006 | Qi et al. | |
| 7,598,913 | B2 | 10/2009 | Rao et al. | |
| 8,106,836 | B2 | 1/2012 | Hill et al. | |
| 9,099,789 | B1 | 8/2015 | Modro | |
| 2002/0019247 | A1 * | 2/2002 | Egorov | H01Q 1/243 455/557 |
| 2002/0171594 | A1 * | 11/2002 | Fang | H01Q 13/10 343/767 |
| 2003/0090426 | A1 * | 5/2003 | Sun | H01Q 1/38 343/770 |
| 2005/0007283 | A1 * | 1/2005 | Jo | H01Q 1/38 343/702 |
| 2005/0078037 | A1 | 4/2005 | Leclerc et al. | |
| 2006/0033666 | A1 * | 2/2006 | Su | H01Q 9/0414 343/700 MS |
| 2007/0164904 | A1 * | 7/2007 | Nahar | H01Q 1/243 343/700 MS |
| 2008/0106481 | A1 * | 5/2008 | Lin | H01Q 9/285 343/793 |
| 2008/0316115 | A1 * | 12/2008 | Hill | H01Q 1/243 343/702 |
| 2008/0316116 | A1 * | 12/2008 | Hobson | H01Q 1/243 343/702 |
| 2008/0316121 | A1 * | 12/2008 | Hobson | H01Q 5/40 343/702 |
| 2009/0058735 | A1 | 3/2009 | Hill et al. | |
| 2009/0153407 | A1 * | 6/2009 | Zhang | H01Q 1/52 343/702 |
| 2009/0153410 | A1 * | 6/2009 | Chiang | H01Q 13/08 343/702 |
| 2009/0256757 | A1 * | 10/2009 | Chiang | H01Q 1/2266 343/702 |
| 2009/0256758 | A1 * | 10/2009 | Schlub | H01Q 5/40 343/702 |
| 2013/0009839 | A1 * | 1/2013 | Nghiem | H01Q 9/42 343/843 |
| 2013/0271326 | A1 * | 10/2013 | Shimasaki | H01Q 9/42 343/700 MS |
| 2014/0111393 | A1 | 4/2014 | Lo Hine Tong et al. | |
| 2014/0184453 | A1 * | 7/2014 | Chen | H01Q 1/243 343/725 |
| 2015/0041541 | A1 * | 2/2015 | Qu | G06K 7/10356 235/439 |
| 2015/0097745 | A1 * | 4/2015 | Chou | H01Q 5/335 343/767 |
| 2015/0102974 | A1 * | 4/2015 | Stoytchev | H01Q 9/285 343/843 |
| 2015/0123861 | A1 * | 5/2015 | Lo Hine Tong | H01Q 13/106 343/767 |
| 2015/0263430 | A1 * | 9/2015 | Lin | H01Q 13/10 343/767 |
| 2015/0311594 | A1 * | 10/2015 | Zhu | H01Q 13/10 343/702 |

FOREIGN PATENT DOCUMENTS

| | | |
|---|---|---|
| CN | 104022362 | 9/2014 |
| KR | 10-2012-0007945 A | 1/2012 |
| TW | 201414078 | 4/2014 |
| WO | WO-2015011468 A1 | 1/2015 |

* cited by examiner

DUAL BAND SLOT ANTENNA

BACKGROUND

Slot antennas may be used for receiving and transmitting electromagnetic radiation. The slot antennas may convert electric power into electromagnetic waves in response to an applied electric field and associated magnetic field. A slot antenna may include a radiating element that may radiate the converted electromagnetic waves.

BRIEF DESCRIPTION OF THE DRAWINGS

Examples are described in the following detailed description and in reference to the drawings, in which.

DETAILED DESCRIPTION

Slot antennas may be used for receiving and transmitting electromagnetic radiation. Example slot antenna may include two slots, curved slot, wider slot aperture, or integrated with active components on ground plane for dual band operation. Example slot antenna maybe a straight, thin, and passive slot for cosmetic and lower cost scenarios. For example, when using a thin and passive slot antenna design, obtaining a dual wide bandwidth (e.g., 2.4 and 5 GHz bands) may be significantly complex as the slot width is directly proportional to antenna bandwidth.

The present application discloses techniques to provide a dual band slot antenna that includes a single slot for dual-band operation. The dual band slot antenna may include a ground plane, a dielectric substrate, a conductive patch, a feed trace, a ground trace, a ground point, and a feeding point. A slot may be etched on the ground plane. In one example, the slot may be a straight slot. Further, the dielectric substrate may be placed in between the conductive patch and the ground plane. Energy may be coupled to the conductive patch via the feeding point or via feeding and ground points for exciting the slot. In addition, the conductive patch can be divided into a feed trace and a ground trace. Both feed and ground traces may include at least one ground point to make electrical connection with the ground plane for dual band operation. Example dual band slot antenna includes a 2D (two-dimensional) antenna or a 3D (three-dimensional) antenna.

Figure 1:
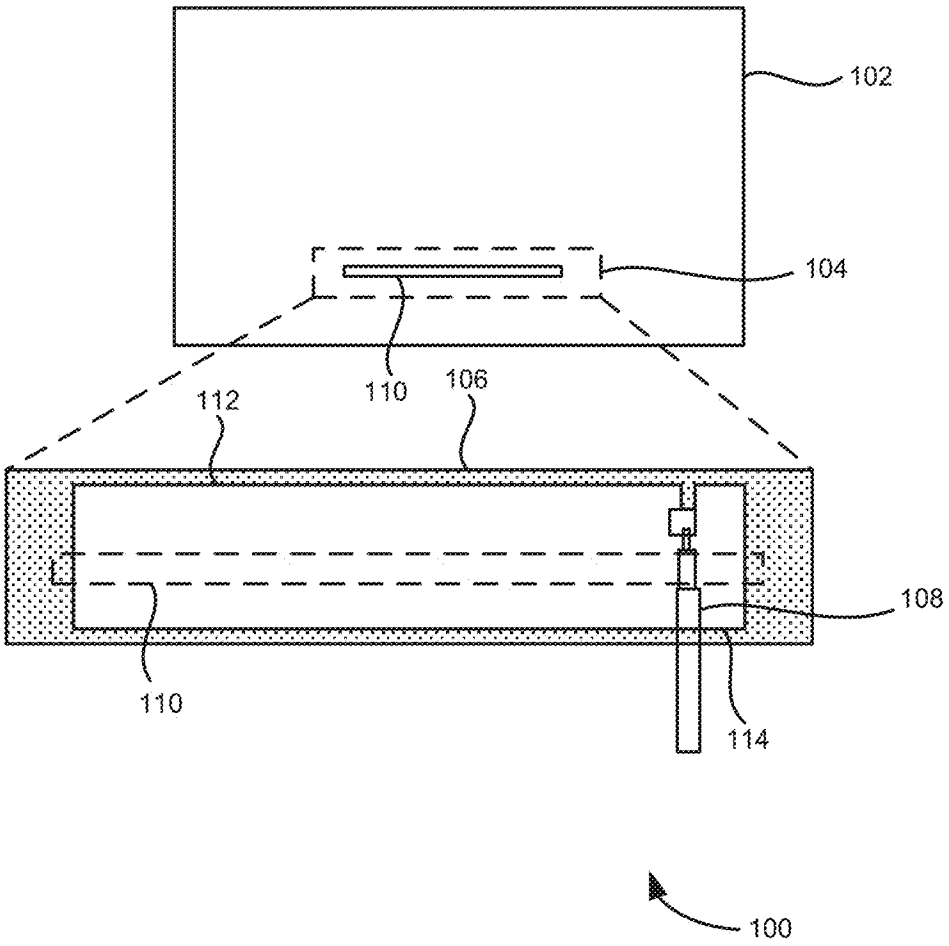
FIG. 1 is a schematic representation of an example dual band slot antenna.
Figure 3:
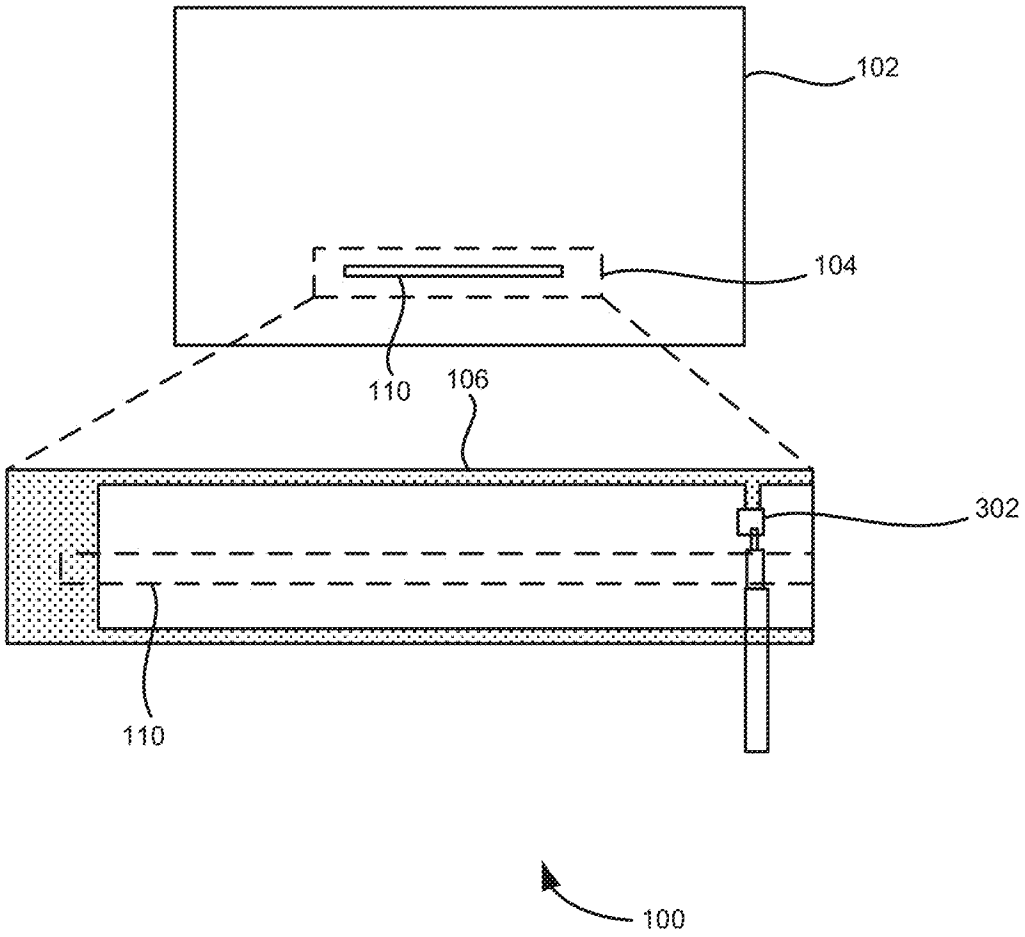
FIG. 3 is a schematic representation of an example dual band slot antenna, such as those shown in FIG. 1, in which a C-shaped conductive patch is applied for dual band operation.

FIG. 1 is a schematic representation of an example dual band slot antenna 100. The dual band slot antenna 100 includes a ground plane 102, a dielectric substrate 104, and a conductive patch 106. The ground plane 102 has a slot 110. The dielectric substrate 104 is disposed/placed in between the conductive patch 106 and the ground plane 102. Further, a coaxial cable 108 may be fastened (e.g., soldered or joined) on the conductive patch 106 to form a first loop region 112 and a second loop region 114 of different sizes for dual band operation. In the example shown in FIG. 1, the conductive patch 106 is an O-shaped structure and may have at least one feeding point (e.g., feeding point 302 as shown in FIG. 3) connected with an inner conductor of coaxial cable 108 and one portion connected with an outer conductor of the coaxial cable 108. In one example, upon soldering of the coaxial cable 108 on the conductive patch 106, two loop structures (e.g., a larger loop region 112 and a smaller loop region 114) placed side by side are formed and the two loops may have different size for dual band operation.

For example, the larger loop region 112 and the smaller loop region 114 may be able to generate 2.4 GHz and 5-6 GHz frequency bands, respectively. Also, a width and shape of the first loop region 112 and the second loop region 114 may be changed such that the conductive patch 106 may be either partially overlapped or fully non-overlapped with the slot 110 for different environments and applications. Energy may be either coupled to the conductive patch 106 via the feeding point or via feeding and ground points for exciting the slot 110.

Figure 2:
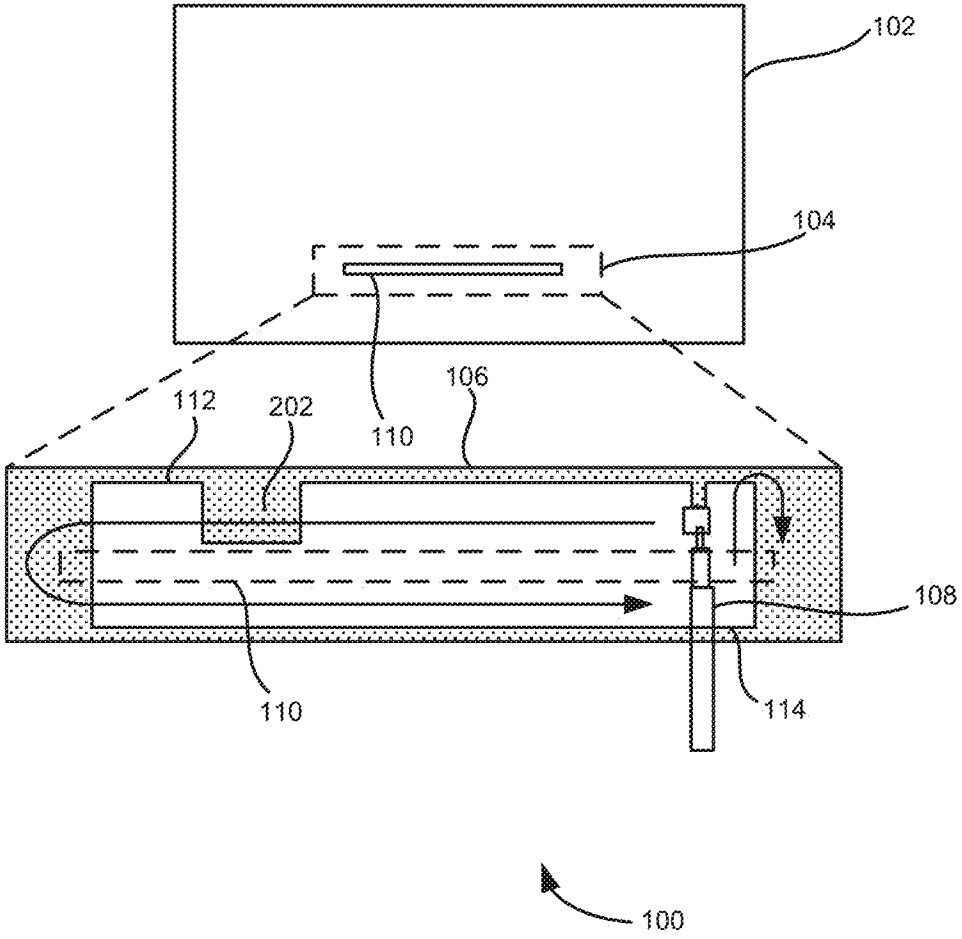
FIG. 2 is a schematic representation of an example dual band slot antenna, such as those shown in FIG. 1, with additional details.

Referring now to FIG. 2, which illustrates a schematic representation of an example dual band slot antenna 100 with additional details. In one example, the conductive patch 106 may include a protrusion stub 202. The protrusion stub 202 may be protruded into the first loop region 112 (e.g., as shown in FIG. 2) and/or the second loop region 114. In one example, the protrusion stub 202 may be overlapped partially or not overlapped with the slot 110 for frequency tuning. In the example, as shown in FIG. 2, the protrusion stub 202 is not overlapped with the slot 110. Similarly, dual band operation frequency can be obtained by different size loop structures (e.g., the larger loop region 112 and the smaller loop region 114) placed side by side.

FIG. 3 to FIG. 6 illustrate different examples of the dual band slot antenna 100, as shown in FIG. 1. These example implementations may be used for frequency tuning for different operating frequencies. For example, FIG. 3 is an example of the dual band slot antenna 100, as shown in FIG. 1, in which a C-shaped conductive patch 106 may be applied for dual band operation. In comparison with FIGS. 1 and 2, one larger loop region 112 can be kept the same for low band operation while smaller loop region 114 can be broken but the dimension of the rest protrusion stubs could still be fine-tuned for high band operation. In one example, the C-shaped conductive patch 106 may be partially overlapped with and fully not overlapped with the slot 110 for frequency tuning. In one example, the C-shaped conductive patch 106 may include a protrusion stub overlapped with the slot 110 for frequency tuning. The C-shaped conductive patch 106 may have no or at least one electrical contact with the ground plane 102. Therefore, energy may be either coupled to the conductive patch 106 via a feeding point 302 or via feeding and ground points for exciting the slot 110.

Figure 4:
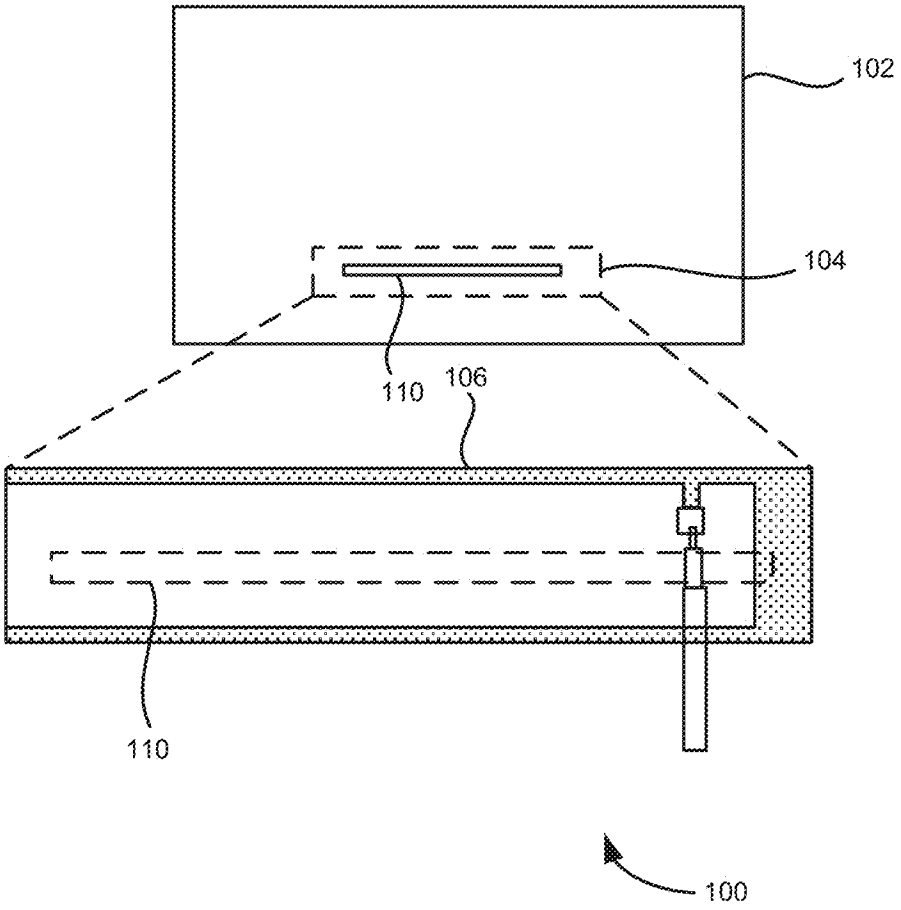
FIG. 4 is a schematic representation of an example dual band slot antenna, such as those shown in FIG. 1, in which an inverted C-shaped conductive patch is applied for dual band operation.

FIG. 4 illustrates another example of the dual band slot antenna 100, as shown in FIG. 1, in which the inverted C-shaped conductive patch 106 is applied for dual band operation. In comparison with FIG. 3, one smaller loop region 114 may be kept the same for high band operation while larger loop region 112 may be broken but the dimension of the rest protrusion stubs could still be fine-tuned for low band operation. In one example, the inverted C-shaped conductive patch 106 may be partially overlapped with and further not overlapped with the slot 110 for frequency tuning. In one example, the inverted C-shaped conductive patch 106 may include a protrusion stub overlapped with the slot 110 for frequency tuning. The inverted C-shaped conductive patch 106 may have no or at least one electrical contact with the ground plane 102. Therefore, energy may be either coupled to the conductive patch 106 via a feeding point or via feeding and ground points for exciting the slot 110.

Figure 5:
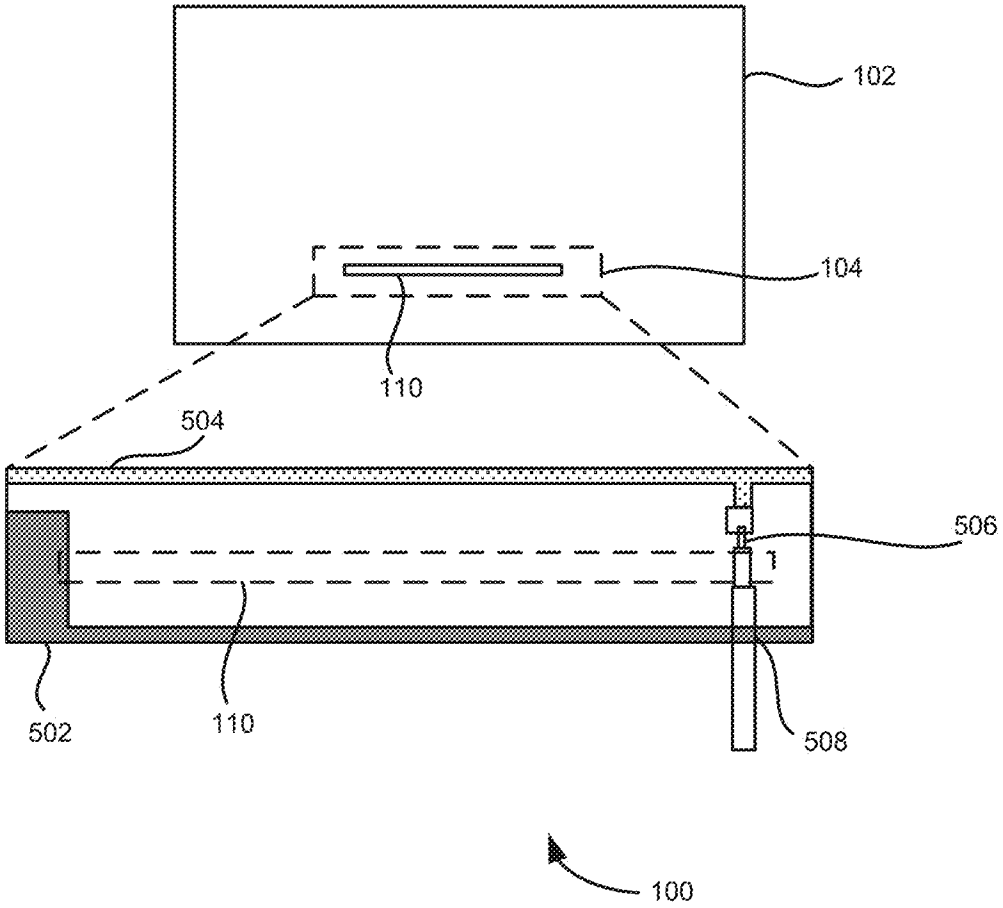
FIG. 5 is a schematic representation of an example dual band slot antenna, such as those shown in FIG. 1, in which a conductive patch is divided into a feed trace and a ground trace.

FIG. 5 illustrates another example of the dual band slot antenna 100 in which conductive patch is divided into a feed trace 504 and a ground trace 502. In the example shown in FIG. 5, the feed trace is directly connected with an inner conductor 506 of the coaxial cable 108 for energy transfer and the ground trace 502 is directly connected with an outer conductor 508 of the coaxial cable 108 for assembly stability and grounding consideration. In the example shown in FIG. 5, an L-shaped ground trace 502 and a T-shaped feed trace 504 are applied for dual band operation. The T-shaped feed trace 504 may operate as a monopole to excite the dual band slot antenna 100 while the L-shaped ground trace 502 may operate as frequency tuning components. In this example, both the feed trace 504 and the ground trace 502 may be partially overlapped and/or fully not overlapped with the slot 110 for frequency tuning. In one example, both the feed trace 504 and the ground trace 502 may include a protrusion stub overlapped with the slot 110 for frequency tuning. Both the feed trace 504 and the ground trace 502 may have no or at least one electrical contact with the ground plane 102. Therefore, energy may be either coupled to the feed trace 504 via a feeding point or via feeding and ground points for exciting the slot 110.

Figure 6:
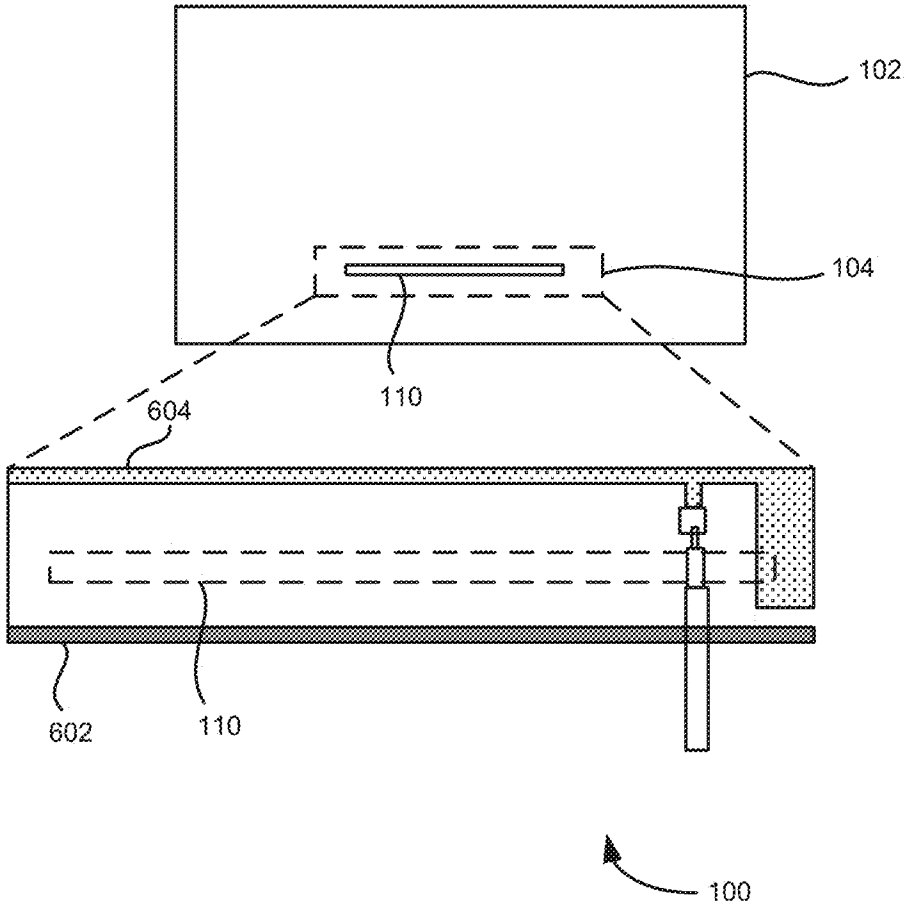
FIG. 6 is a schematic representation of an example dual band slot antenna, such as those shown in FIG. 1, which includes a substantially straight ground trace and an F-shaped feed trace for dual band operation.

FIG. 6 illustrates another example of the dual band slot antenna 100, in which a substantially straight ground trace 602 and an F-shaped feed trace 604 are applied for dual band operation. Even though FIGS. 5 and 6 describe about the feed trace that includes a T-shape and/or F-shape structure and the ground trace that includes an L-shape and straight line-shape structure, any other structure can be implemented to achieve the dual band operation.

For example, in slot antenna designs, a significant portion of radio frequency (RF) power may leak away from the slot region in the form of surface wave propagating along the ground plane. When components, such as panel or circuit control board (e.g., metallic objects surrounding the slot), mounted on the same ground plane, this surface wave may be bounded by these metallic objects and transferred into parallel plate wave thereby reducing the radiation intensity significantly. The present subject matter can propose a 3D antenna instead of 2D antenna. This proposed technique may make surface wave propagate through a vertical portion of 3D antenna and radiating outside of bounded metallic objects before it is bounded by metallic objects surrounding the slot thereby largely enhancing radiation intensity. This technique may propose conductive patch or feed/ground traces from 2D (two-dimensional) to 3D (three-dimensional) as shown in FIG. 7.

FIG. 7 illustrates an example design comparison of a 2D flexible printed circuit (FPC) antenna and a 3D metal sheet antenna. FIG. 7A illustrates a top view of the 2D FPC antenna. In the example shown in FIG. 7A, both the feed trace 706 and the ground trace 704 are having ground points 701A and 701B, respectively, for making electrical contact with the ground plane 102. The feed trace 706 may include a T-shape and/or F-shape structure and the ground trace 704 may include an L-shape and straight line-shape structure as shown in FIGS. 5 and 6. FIG. 7B shows a side view of 2D FPC antenna.

Figure 7A:
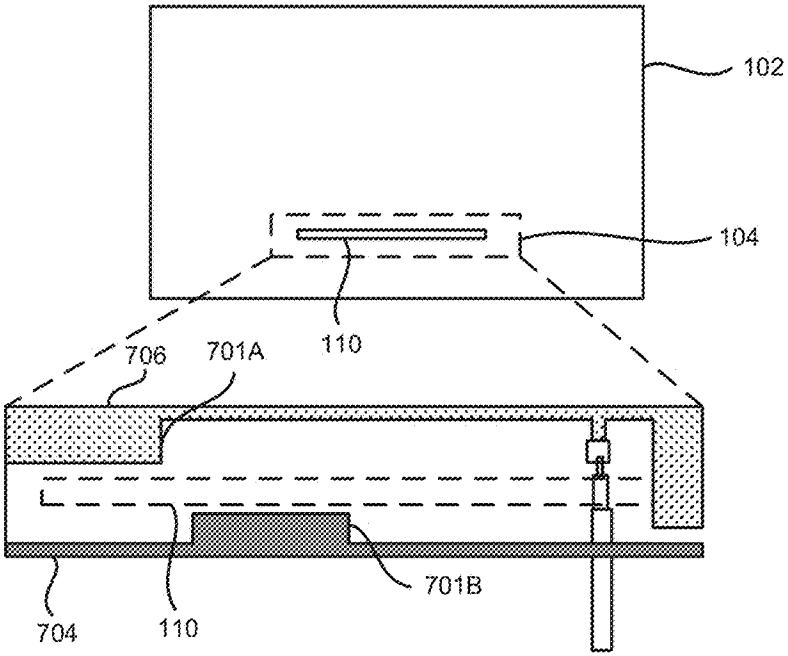
FIGS. 7A-7G illustrate an example design comparison of a 2D flexible printed circuit (FPC) antenna and a 3D metal sheet antenna.
Figure 7B:
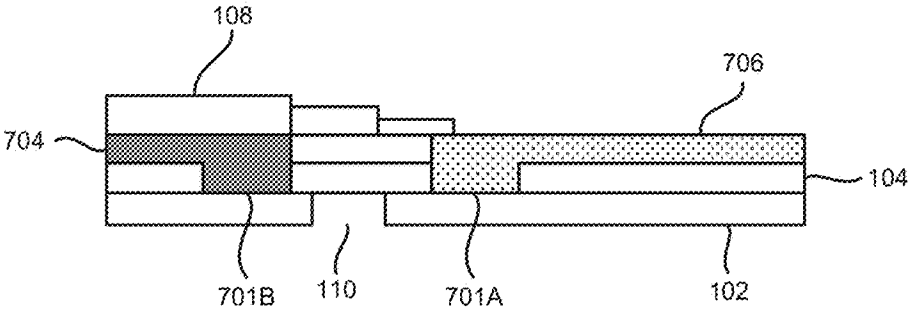
Figure 7C:
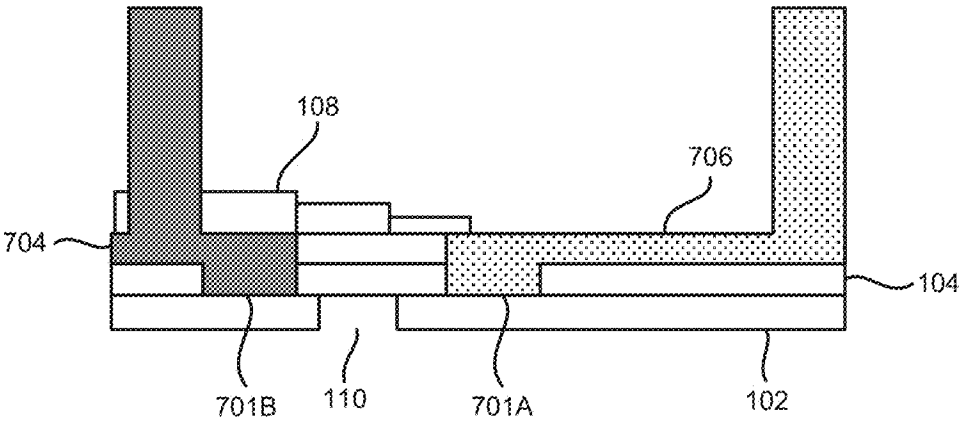
Figure 7D:
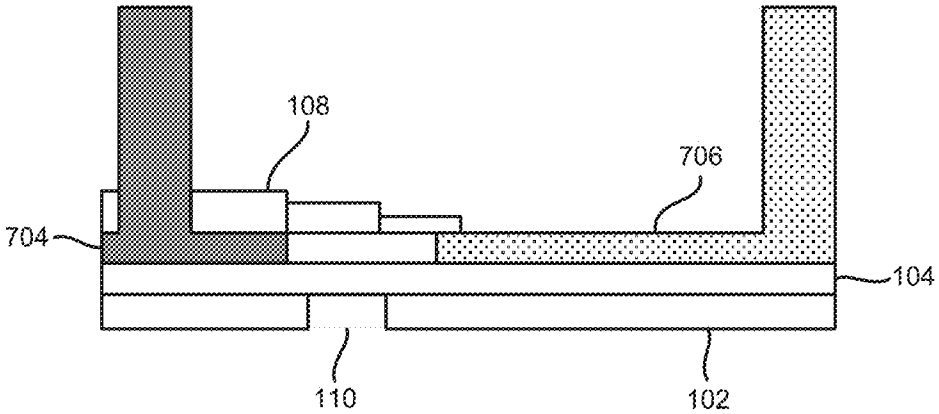

FIGS. 7C and 7D illustrate a side view of the 3D metal sheet antenna. As shown in FIG. 7C, both the feed trace 706 and the ground trace 704 are changed to 3D type of antenna for enhancing performance of the antenna and include ground points 701A and 701B, respectively, for making electrical contact with the ground plane 102. In the example shown in FIG. 7D, ground points 701A and 701B (e.g., as shown in FIG. 7C) are removed from both the feed trace 706 and the ground trace 704 for electrically coupling energy to the slot 110 on the ground plane 102.

Figure 7F:
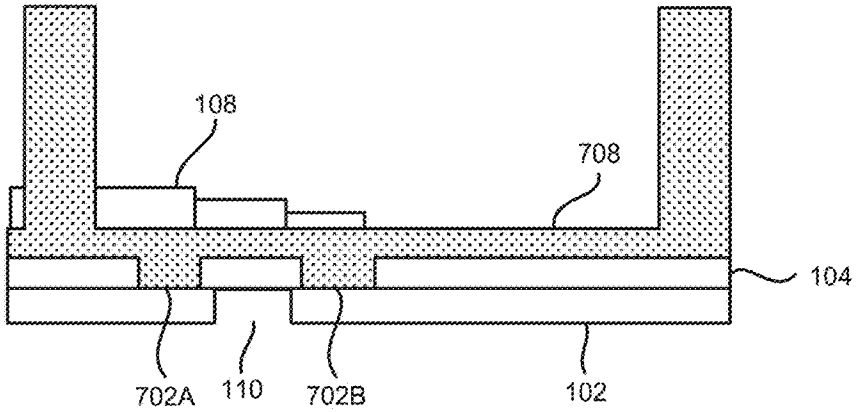
Figure 7E:
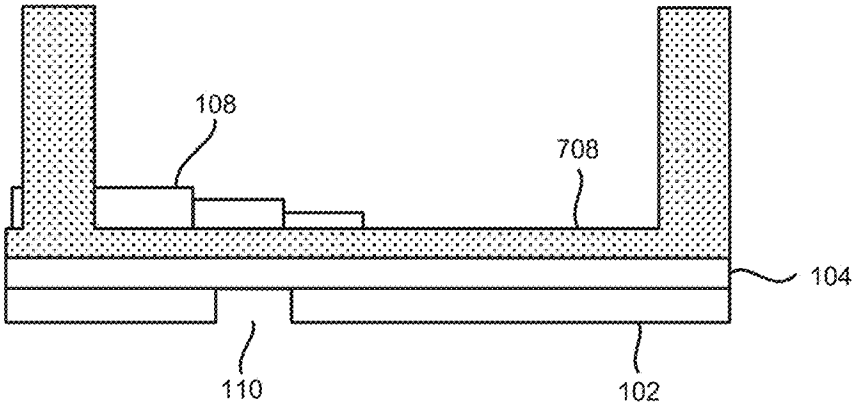
Figure 7G:
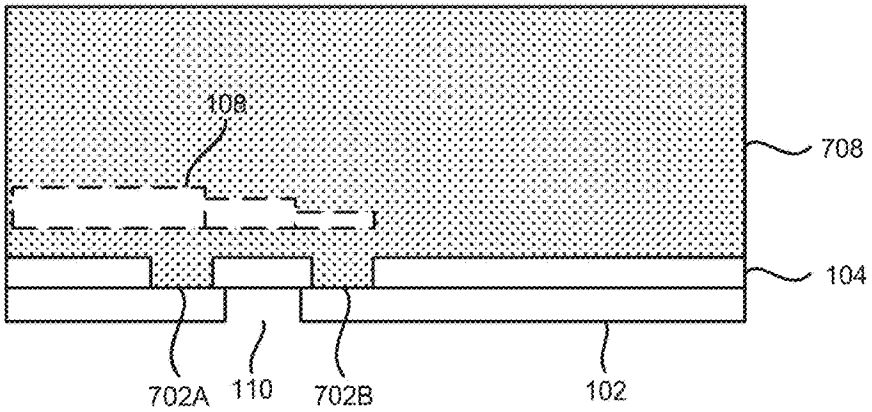

FIGS. 7E, 7F, and 7G illustrate a side view of the 3D metal sheet antenna with the conductive patch 708 (e.g., such as the conductive patch 106 shown in FIG. 1). As shown in FIGS. 7E and 7F, the 3D metal sheet antenna includes the conductive patch 708 (e.g., without and with ground points 702A and 702B, respectively) for enhancing performance of the antenna. Similarly, a structure shown in FIG. 7G can be designed, where the vertical portion of conductive patch 708 can be designed to be across the slot region. In the example shown in FIGS. 7C to 7G, the conductive patch of the 3D antenna comprises at least a portion (e.g., a substantially vertical metal rib) that extends outwardly from the dielectric substrate and surrounds at least a side of the slot. In the examples shown in FIGS. 7C to 7G, the conductive patch 708 can be partitioned into the feed trace 706 and the ground trace 704.

The 3D structure may not be limited to using a single material, for example metal sheet, but also different materials can be used for combination. For example, PCB can be combined with metal sheet for 3D antenna. Another example for this design can use plastic holder with conductive material on its surface to form 3D antenna.

It may be noted that the above-described examples of the present solution is for the purpose of illustration only. Although the solution has been described in conjunction with a specific embodiment thereof, numerous modifications may be possible without materially departing from the teachings and advantages of the subject matter described herein. Other substitutions, modifications and changes may be made without departing from the spirit of the present solution. All of the features disclosed in this specification (including any accompanying claims, abstract and drawings) may be combined in any combination, except combinations where at least some of such features are mutually exclusive.

The terms "include," "have," and variations thereof, as used herein, have the same meaning as the term "comprise" or appropriate variation thereof. Furthermore, the term "based on," as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter that is defined in the following claims.

What is claimed is:

1. A dual band slot antenna comprising:

a ground plane having a single slot;

a conductive patch;

a dielectric substrate having a first side and a second side opposite the first side, the dielectric substrate disposed between the conductive patch and the ground plane, wherein the first side of the dielectric substrate is in contact with the ground plane, and the second side of the dielectric substrate is in contact with the conductive patch to substantially separate the ground plane and the conductive patch; and a coaxial cable fastened on the conductive patch;

wherein the conductive patch comprises:

a substantially vertical metal rib extending outwardly from the dielectric substrate and surrounding at least a side of the slot; and a feeding point to connect to an inner conductor of the coaxial cable and a portion to connect to an outer conductor of the coaxial cable to form a first radiative region of the conductive patch to generate a first frequency band and a second radiative region of the conductive patch to generate a second frequency band.

2. The dual band slot antenna of claim 1, wherein the conductive patch comprises a protrusion stub in at least one of the first radiative region and the second radiative region, wherein the protrusion stub is partially overlapped or not overlapped with the slot, and wherein the conductive patch partially overlaps or not overlaps with the slot.

3. The dual band slot antenna of claim 1, wherein the conductive patch includes at least one ground point to make at least one electrical connection with the ground plane for dual band operation.

4. The dual band slot antenna of claim 1, wherein the conductive patch comprises a structure selected from a group consisting of an O-shape, a C-shape and an inverted C shape.

5. The dual band slot antenna of claim 1, wherein the dual band slot antenna comprises one of a two-dimensional (2D) antenna and a three-dimensional (3D) antenna.

6. The dual band slot antenna of claim 1, wherein the first radiative region comprises a first looped formed in the conductive patch with respect to the coaxial cable, and the second radiative region comprises a second loop formed in the conductive patch with respect to the coaxial cable.

7. A three-dimensional (3D) dual band slot antenna comprising:

a ground plane having a single slot;

a conductive patch;

a dielectric substrate having a first side and a second side opposite the first side, the dielectric substrate disposed between the conductive patch and the ground plane, wherein the first side of the dielectric substrate is in contact with the ground plane, and the second side of the dielectric substrate is in contact with the conductive patch to substantially separate the ground plane and the conductive patch; and a coaxial cable fastened on the conductive patch;

wherein the conductive patch comprises:

a substantially vertical metal rib extending outwardly from the dielectric substrate and surrounding at least a side of the slot; and a feeding point to connect to an inner conductor of the coaxial cable and a portion to connect to an outer conductor of the coaxial cable to form a first radiative region of the conductive patch to generate a first frequency band and a second radiative region of the conductive patch to generate a second frequency band.

8. The 3D dual band slot antenna of claim 7, wherein the conductive patch comprises at least a portion that extends outwardly from the dielectric substrate and surrounds at least a side of the slot.

9. The 3D dual band slot antenna of claim 7, wherein the conductive patch includes at least one ground point to make at least one electrical connection with the ground plane for the dual band operation, and wherein the conductive patch partially overlaps or not overlaps with the slot.

10. A dual band slot antenna comprising:

a ground plane having a single slot;

a conductive patch, wherein the conductive patch is partitioned into a feed trace and a ground trace;

a dielectric substrate having a first side and a second side opposite the first side, the dielectric substrate disposed between the conductive patch and the ground plane, wherein the first side of the dielectric substrate is in contact with the ground plane, and the second side of the dielectric substrate is in contact with the feed trace and the ground trace to substantially separate the ground plane and the conductive patch; and a coaxial cable fastened on the conductive patch, wherein the feed trace is connected to an inner conductor of the coaxial cable and the ground trace is connected to an outer conductor of the coaxial cable to form a first radiative region to generate a first frequency band and a second radiative region to generate a second frequency band; and wherein the conductive patch further comprises a substantially vertical metal rib extending outwardly from the dielectric substrate and surrounding at least a side of the slot.

11. The dual band slot antenna of claim 10, wherein at least one of the feed trace and the ground trace comprises a protrusion stub in at least one of the first radiative region and the second radiative region, wherein the protrusion stub is partially overlapped or not overlapped with the slot.

12. The dual band slot antenna of claim 10, wherein the feed trace and ground trace include at least one ground point to make at least one electrical connection with the ground plane for dual band operation.

13. The dual band slot antenna of claim 10, wherein each of the feed trace and the ground trace partially overlaps or not overlaps with the slot.

14. The dual band slot antenna of claim 10, wherein the feed trace comprises a structure selected from a group consisting of T-shape and F-shape and wherein the ground trace comprises a structure selected from a group consisting of an L-shape and straight line-shape.

15. The dual band slot antenna of claim 10, wherein the first radiative region comprises a first feed trace portion and a first ground trace portion to tune the first radiative region to generate the first bandwidth, and the second radiative region comprises a second feed trace portion and a second ground trace portion to tune the second radiative region to generate the second bandwidth.

* * * * *